US011446937B2

(12) United States Patent
Tatsuta et al.

(10) Patent No.: US 11,446,937 B2
(45) Date of Patent: Sep. 20, 2022

(54) PRINTING APPARATUS

(71) Applicant: SEIKO EPSON CORPORATION, Tokyo (JP)

(72) Inventors: Kohei Tatsuta, Nagano (JP); Tadashi Ishikawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/210,641

(22) Filed: Mar. 24, 2021

(65) Prior Publication Data

US 2021/0300065 A1 Sep. 30, 2021

(30) Foreign Application Priority Data

Mar. 26, 2020 (JP) ..... JP2020-055865

(51) Int. Cl.
*B41J 11/00* (2006.01)
*B41J 29/393* (2006.01)
*B41J 2/195* (2006.01)

(52) U.S. Cl.
CPC ..... *B41J 11/002* (2013.01); *B41J 2/195* (2013.01); *B41J 29/393* (2013.01)

(58) Field of Classification Search
CPC ..... B41J 11/002; B41J 2/195; B41J 29/393; B41J 2/2142; B41J 11/00212; B41J 29/02
See application file for complete search history.

(56) References Cited

U.S. PATENT DOCUMENTS

2006/0055734 A1* 3/2006 Kadomatsu ..... B41J 11/0021 347/55
2008/0278528 A1 11/2008 Kim
2020/0114668 A1 4/2020 Havive et al.

FOREIGN PATENT DOCUMENTS

JP 2006-076202 A 3/2006

* cited by examiner

*Primary Examiner* — Bradley W Thies
(74) *Attorney, Agent, or Firm* — Global IP Counselors, LLP

(57) ABSTRACT

A printing apparatus includes a medium accommodation portion that accommodates a medium, a medium discharge port for discharging the medium to an outside of the printing apparatus, a medium transport section that transports the medium along a transport path from the medium accommodation portion toward the medium discharge port, an ejection head that ejects a liquid to the medium to form an image on the medium, a heat generation section that dries the liquid ejected to the medium by heat, and an image detection section that detects the image formed on the medium. The ejection head, the heat generation section, and the image detection section are provided along the transport path. The ejection head is located between the heat generation section and the image detection section in a direction along the transport path.

8 Claims, 9 Drawing Sheets

PRINTING APPARATUS

The present application is based on, and claims priority from JP Application Serial Number 2020-055865, filed Mar. 26, 2020, the disclosure of which is hereby incorporated by reference herein in its entirety.

BACKGROUND

1. Technical Field

The present disclosure relates to a printing apparatus provided with a mechanism for detecting an ink ejection state using an optical sensor.

2. Related Art

As a technique for a printing apparatus that ejects an ink to a medium to form an image on the medium, the technique of detecting the image formed on the medium with a sensor element to determine an ejection state of the ink ejected from the printing apparatus or a state of the image formed on the medium by the printing apparatus, for example, a technique as disclosed in JP-A-2006-076202 is known.

However, in the printing apparatus as disclosed in JP-A-2006-076202, heat generated by a drying mechanism for drying the ink ejected to a medium has an influence on the sensor element that detects the state of the image formed on the medium. Therefore, the characteristics of the sensor element may change. That is, the printing apparatus disclosed in JP-A-2006-076202 has a room for improvement from the viewpoint of further improving the detection accuracy of detecting the state of the image formed on the medium by using the sensor element.

SUMMARY

According to an aspect of the present disclosure, a printing apparatus includes a medium accommodation portion that accommodates a medium, a medium discharge port for discharging the medium to an outside of the printing apparatus, a medium transport section that transports the medium along a transport path from the medium accommodation portion toward the medium discharge port, an ejection head that ejects a liquid to the medium to form an image on the medium, a heat generation section that dries the liquid ejected to the medium by heat, and an image detection section that detects the image formed on the medium. The ejection head, the heat generation section, and the image detection section are provided along the transport path. The ejection head is located between the heat generation section and the image detection section in a direction along the transport path.

DESCRIPTION OF EXEMPLARY EMBODIMENTS

Hereinafter, a preferred embodiment of the present disclosure will be described with reference to the drawings. The drawings used are for convenience of description. The embodiment described below does not unreasonably limit the contents of the aspects described in the claims. All components described below are not essential constituent requirements of the present disclosure.

1. Functional Configuration of Printing Apparatus

Figure 1A:
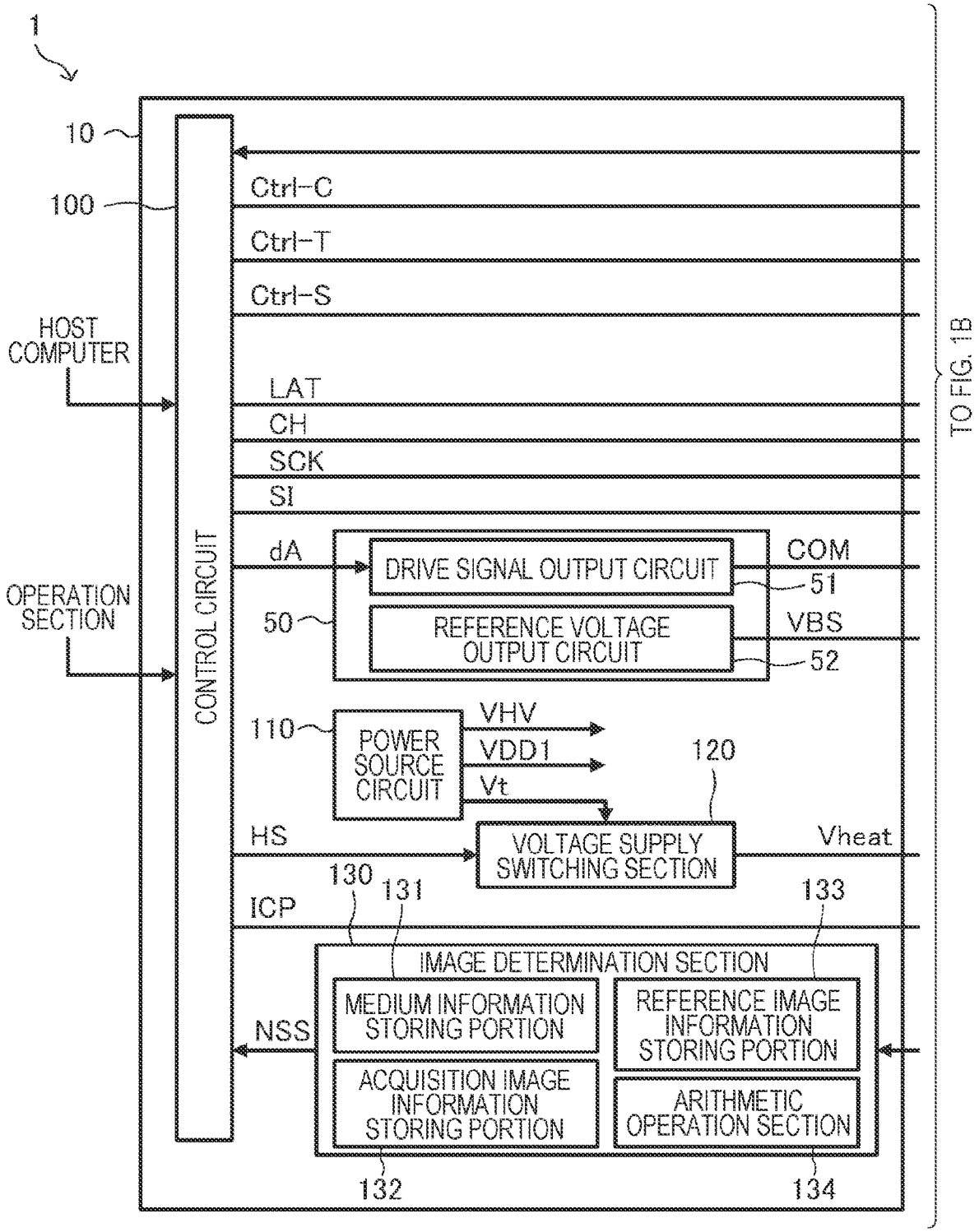
FIGS. 1A and 1B are diagrams illustrating a functional configuration of a printing apparatus.
Figure 1B:
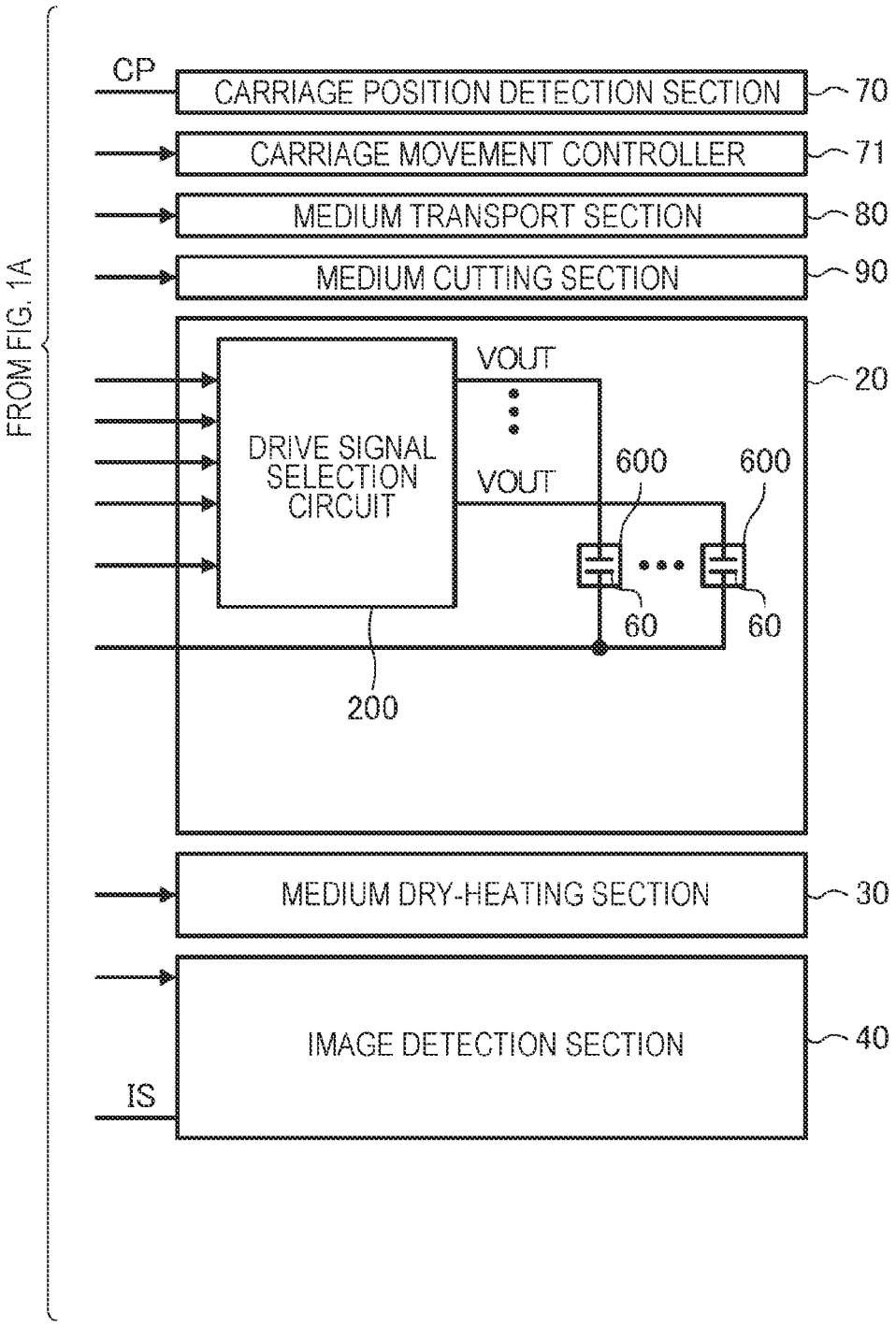

FIGS. 1A and 1B are diagrams illustrating a functional configuration of a printing apparatus 1 according to an embodiment. The printing apparatus 1 in the embodiment will be described with an example of a so-called serial type ink jet printer. The serial type ink jet printer transports a printing medium wound in a roll shape, and ejects an ink to the printing medium from a print head 20 that moves back and forth in a width direction of the printing medium. The width direction intersects with a direction in which the printing medium is transported, so as to form a desired image on the printing medium.

As illustrated in FIGS. 1A and 1B, the printing apparatus 1 includes a control mechanism 10, the print head 20, a medium dry-heating section 30, an image detection section 40, a carriage movement controller 71, a carriage position detection section 70, a medium transport section 80, and a medium cutting section 90.

The control mechanism 10 includes a drive circuit 50, a control circuit 100, a power source circuit 110, a voltage supply switching section 120, and an image determination section 130. The control mechanism 10 generates various signals for controlling the print head 20, the medium dry-heating section 30, the image detection section 40, the carriage movement controller 71, the carriage position detection section 70, the medium transport section 80, and the medium cutting section 90, and then outputs the generated signals to the corresponding components.

The control circuit 100 includes a processor such as a microcontroller, for example. The control circuit 100 generates and outputs various types of data or various signals for controlling the printing apparatus 1, based on various signals including image data input from an operation section including a switch and the like or from a host computer or the like provided outside the printing apparatus.

A specific example of an operation of the control circuit 100 will be described. The control circuit 100 recognizes the scanning position of a carriage 21 described later, based on a position information signal CP input from the carriage position detection section 70. The print head 20 is mounted in the carriage. The control circuit 100 generates a control signal Ctrl-C corresponding to the position information signal CP and outputs the control signal Ctrl-C to the carriage movement controller 71. The carriage movement controller 71 controls the back and forth movement of the carriage 21 in which the print head 20 is mounted, in accordance with the control signal Ctrl-C. The control signal Ctrl-C may be converted through a driver circuit (not illustrated) and then be input to the carriage movement controller 71.

The control circuit 100 generates a control signal Ctrl-T and outputs the control signal Ctrl-T to the medium transport section 80. The medium transport section 80 transports the printing medium in a predetermined transport direction in response to the control signal Ctrl-T. The control signal Ctrl-T may be converted through the driver circuit (not illustrated) and then be input to the medium transport section 80.

The control circuit 100 generates a control signal Ctrl-S and outputs the control signal Ctrl-S to the medium cutting section 90. The medium cutting section 90 cuts the roll-shaped printing medium that is transported by the medium transport section 80, to a predetermined size in accordance with the control signal Ctrl-S. The control signal Ctrl-S may be converted through the driver circuit (not illustrated) and then be input to the medium cutting section 90.

The control circuit 100 generates a print data signal SI, a change signal CH, and a latch signal LAT, and a clock signal SCK for controlling the print head 20, based on various signals such as image data input from the host computer, and the position information CP. Then, the control circuit outputs the generated signals to the print head 20.

The control circuit 100 outputs a drive control signal dA being a digital signal, to the drive circuit 50.

The drive circuit 50 includes a drive signal output circuit 51 and a reference voltage output circuit 52. The drive control signal dA is input to the drive signal output circuit 51. The drive signal output circuit 51 performs digital/analog conversion of the drive control signal dA. Then, the drive signal output circuit amplifies the converted analog signal in class D to generate the drive signal COM and outputs the drive signal COM to the print head 20. That is, the drive control signal dA is a digital signal for defining the waveform of the drive signal COM. The drive signal output circuit 51 generates the drive signal COM by amplifying the waveform defined by the drive control signal dA in class D. Thus, the drive control signal dA may be any signal enabled to define the waveform of the drive signal COM. For example, the drive control signal dA may be an analog signal. The drive signal output circuit 51 may be capable of amplifying the waveform defined by the drive control signal dA. For example, the drive signal output circuit may be configured by a class A amplifier circuit, a class B amplifier circuit, or a class AB amplifier circuit, for example.

The reference voltage output circuit 52 generates a reference voltage signal VBS indicating the reference potential of the drive signal COM, and outputs the reference voltage signal VBS to the print head 20. Here, the reference voltage signal VBS may be, for example, a signal having a ground potential having a voltage value of 0 V, or may be a signal having a DC voltage having a voltage value of 5.5 V, 6 V, or the like.

The print head 20 includes a drive signal selection circuit 200 and a plurality of ejection sections 600. The drive signal selection circuit 200 is configured as, for example, an integrated circuit device. The drive signal COM, the print data signal SI, the clock signal SCK, the latch signal LAT, and the change signal CH are input to the drive signal selection circuit 200. The drive signal selection circuit 200 selects or deselects a signal waveform included in the drive signal COM, based on the print data signal SI, the clock signal SCK, the latch signal LAT, and the change signal CH, which are input. In this manner, the drive signal selection circuit generates a drive signal VOUT and outputs the drive signal VOUT to the corresponding ejection section 600.

Each of the plurality of ejection sections 600 includes a piezoelectric element 60. The drive signal VOUT output by the drive signal selection circuit 200 is supplied in a manner that the drive signal VOUT is supplied to one end of the piezoelectric element 60. The reference voltage signal VBS output by the reference voltage output circuit 52 is supplied to the other end of the piezoelectric element 60. The piezoelectric element 60 is driven in accordance with the potential difference between the drive signal VOUT and the reference voltage signal VBS. An ink having an amount depending on the displacement generated by driving the piezoelectric element 60 is ejected from the ejection section 600.

Figure 2:
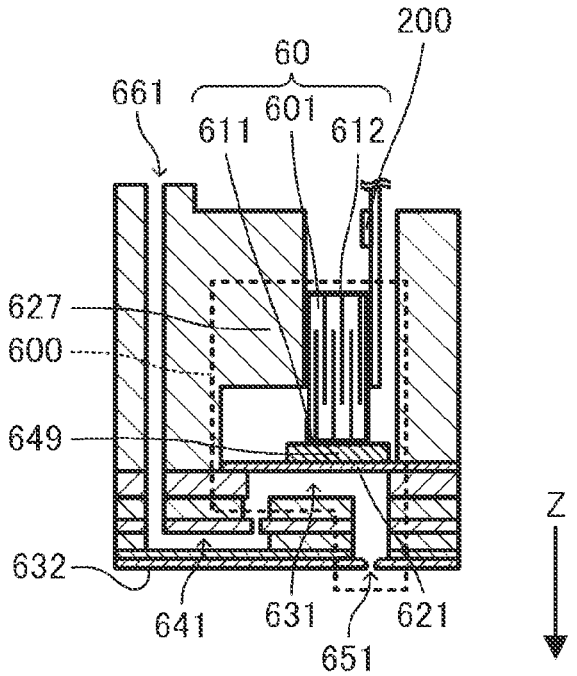
FIG. 2 is a schematic diagram illustrating a configuration of an ejection section.

Here, an example of a configuration of the ejection section 600 will be described with reference to FIG. 2. FIG. 2 is a schematic diagram illustrating the configuration of the ejection section 600. As illustrated in FIG. 2, the ejection section 600 includes the piezoelectric element 60, a vibration plate 621, a cavity 631, and a nozzle 651.

The piezoelectric element 60 is a stacked piezoelectric vibrator in which a piezoelectric material 601 is stacked to be interposed between electrodes 611 and 612, and then the resultant is cut into an elongated comb-teeth shape. The drive signal VOUT is supplied to the electrode 611. The reference voltage signal VBS is supplied to the electrode 612. The piezoelectric element 60 is a so-called vertical vibration type piezoelectric vibrator that performs displacement in an up-down direction illustrated in FIG. 3, which is a longitudinal direction of the piezoelectric element 60, in accordance with the potential difference between the drive signal VOUT supplied to the electrode 611 and the reference voltage signal VBS supplied to the electrode 612. A fixed end portion of the piezoelectric element 60 is joined to a fixing portion 627. A free end portion of the piezoelectric element 60 protrudes outward from the tip edge of the fixing portion 627. That is, in the ejection section 600, the piezoelectric element 60 is provided in a so-called cantilever state. The tip surface of the free end portion of the piezoelectric element 60 is joined to an island portion 649 provided above the vibration plate 621.

The vibration plate 621 is located below the island portion 649 in FIG. 2. The vibration plate 621 is deformed with the displacement of the piezoelectric element 60 provided through the island portion 649. The cavity 631 is provided below the vibration plate 621. That is, the vibration plate 621 functions as a diaphragm that increases and reduces the internal volume of the cavity 631 by deforming with the displacement of the piezoelectric element 60. The inside of the cavity 631 is filled with an ink supplied through an ink supply port 661 and a reservoir 641. The nozzle 651 is an opening portion that is formed in the nozzle plate 632 and communicates with the cavity 631.

In the ejection section 600 configured as described above, the vibration plate 621 deforms with the displacement of the piezoelectric element 60, and the internal volume of the cavity 631 changes depending on the deformation of the vibration plate 621. As a result, the internal pressure of the cavity 631 changes, and the ink stored in the cavity 631 is ejected from the nozzle 651.

Next, an example of the drive signal VOUT supplied to the ejection section 600 will be described. As described above, the drive signal VOUT is generated by the drive signal selection circuit 200 selecting or not selecting the signal waveform included in the drive signal COM output by the drive signal output circuit 51. Therefore, in describing the example of the drive signal VOUT, an example of the waveform of the drive signal COM will be described first, and then an example of the drive signal VOUT corresponding to the drive signal COM will be described.

Figure 3:
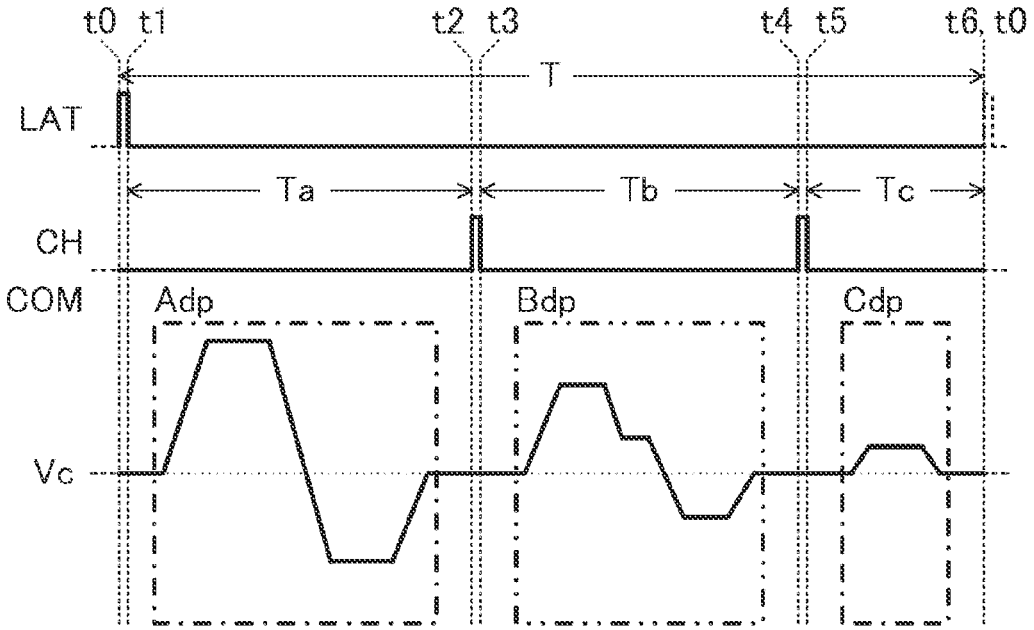
FIG. 3 is a diagram illustrating an example of a waveform of a drive signal COM.

FIG. 3 is a diagram illustrating the example of the waveform of the drive signal COM. As illustrated in FIG. 3, the drive signal COM has a waveform in which trapezoidal waveforms Adp, Bdp, and Cdp are consecutively arranged in a period T from when the latch signal LAT rises at a time point t0 until the latch signal LAT rises next at a time point t6. Voltage values of the trapezoidal waveforms Adp, Bdp, and Cdp at the start timings and end timings of the trapezoidal waveforms Adp, Bdp, and Cdp are all common to a voltage Vc. That is, each of the trapezoidal waveforms Adp, Bdp, and Cdp is a waveform that starts at the voltage Vc and ends at the voltage Vc.

The trapezoidal waveform Adp is disposed in a period Ta between a time point t1 at which the latch signal LAT falls after the latch signal LAT rises at the time point t0 and a time point t2 at which the change signal CH rises. The trapezoidal waveform Bdp is disposed in a period Tb between a time point t3 at which the change signal CH falls after the change signal CH rises at the time point t2 and a time point t4 at which the change signal CH rises next. The trapezoidal waveform Cdp is disposed in a period Tc between a time point t5 at which the change signal CH falls after the change signal CH rises at the time point t4 and a time point t6 at which the latch signal LAT rises. Here, the time point t6 corresponds to the above-described time point t0. That is, the drive signal COM is a signal including a waveform in which the trapezoidal waveforms Adp, Bdp, and Cdp are repeated in the period T.

When the trapezoidal waveform Adp included in the drive signal COM is supplied to one end of the piezoelectric element 60, the ink having a medium amount is ejected from the ejection section 600 corresponding to the piezoelectric element 60. When the trapezoidal waveform Bdp included in the drive signal COM is supplied to the one end of the piezoelectric element 60, the ink having a small amount less than the medium amount is ejected from the ejection section 600 corresponding to the piezoelectric element 60. When the trapezoidal waveform Cdp included in the drive signal COM is supplied to one end of the piezoelectric element 60, the ink is not ejected from the ejection section 600 corresponding to the piezoelectric element 60. The trapezoidal waveform Cdp is a waveform for slightly vibrating the ink in the vicinity of the nozzle opening portion of the ejection section 600 to prevent an increase in ink viscosity. The drive signal COM may be a signal having one trapezoidal waveform in the period T, or may be a signal having a waveform in which two or four or more consecutive trapezoidal waveforms are provided.

Figure 4:
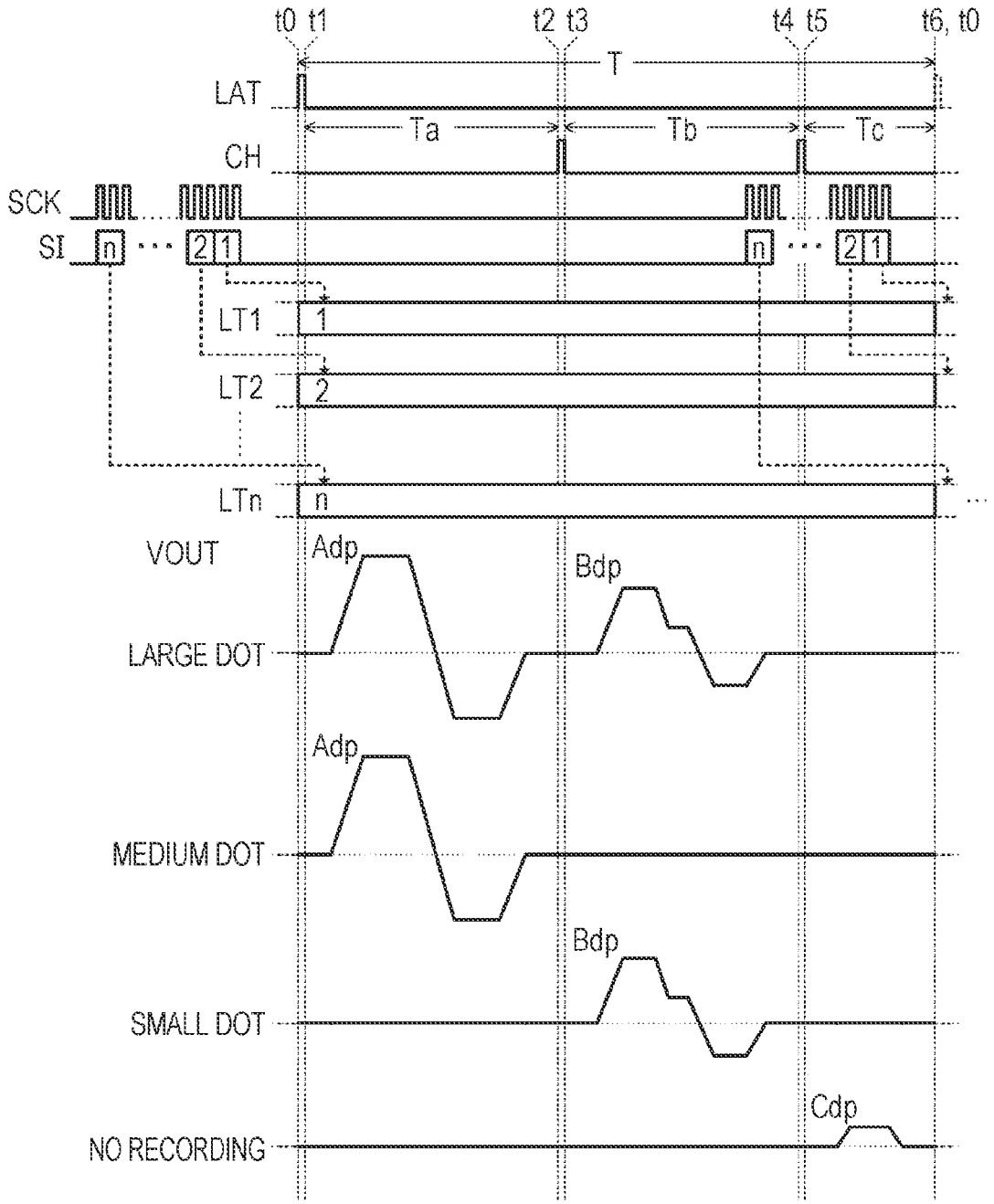
FIG. 4 is a diagram illustrating an operation of a drive signal selection circuit that generates a drive signal VOUT.

Next, the drive signal VOUT generated by the drive signal selection circuit 200 based on the drive signal COM illustrated in FIG. 3 will be described with reference to FIG. 4. FIG. 4 is a diagram illustrating an operation of the drive signal selection circuit 200 that generates the drive signal VOUT. The drive signal selection circuit 200 generates the drive signal VOUT as illustrated in FIG. 4, by switching whether or not to select the trapezoidal waveforms Adp, Bdp, and Cdp included in the drive signal COM in each of the periods Ta, Tb, and Tc defined by the latch signal LAT and the change signal CH. The drive signal selection circuit generates the drive signal VOUT based on the print data signal SI input in synchronization with the clock signal SCK. The drive signal selection circuit outputs the generated drive signal VOUT to the corresponding ejection section 600.

Specifically, as illustrated in FIG. 4, the print data signal SI is a signal serially including m pieces of print data respectively corresponding to m ejection sections 600. The print data signal SI is input to the drive signal selection circuit 200 in synchronization with the clock signal SCK. The m pieces of print data input to the drive signal selection circuit 200 are stored in registers (not illustrated) respectively corresponding to the ejection sections 600. Specifically, the print data corresponding to the i-th ejection section 600 (i is any of 1 to m) among the m ejection sections 600 is stored in the i-th register corresponding to the i-th ejection section 600. When all the m pieces of print data are stored in the corresponding m registers, the supply of the clock signal SCK is stopped.

The m pieces of print data respectively stored in the m registers are latched all at once at the rising timing of the latch signal LAT. The drive signal selection circuit 200 switches whether or not to select the trapezoidal waveforms Adp, Bdp, and Cdp included in the drive signal COM in each of the periods Ta, Tb, and Tc, in accordance with which of "large dot", "medium dot", "small dot", and "no recording" corresponds to each of the m pieces of print data latched all at once. Thus, drive signals VOUT corresponding to each of the m ejection sections 600 are generated.

When the latched print data corresponds to the "large dot", the drive signal selection circuit 200 generates the drive signal VOUT having a waveform in which the trapezoidal waveform Adp disposed in the period Ta, the trapezoidal waveform Bdp disposed in the period Tb, and a constant waveform with the voltage Vc, which is disposed in the period Tc are continuous in the period T. When the generated drive signal VOUT is supplied to one end of the piezoelectric element 60, from the ejection section 600 corresponding to the piezoelectric element 60, the medium amount of ink is ejected in the period Ta, and the small amount of ink is ejected in the period Tb. In the period Tc, the ink is not ejected. As a result, in the period T, the medium amount of ink and the small amount of ink land on the printing medium, and the inks are combined to form a large dot.

When the latched print data corresponds to the "medium dot", the drive signal selection circuit 200 generates the drive signal VOUT having a waveform in which the trapezoidal waveform Adp disposed in the period Ta, the constant waveform with the voltage Vc, which is disposed in the period Tb, and the constant waveform with the voltage Vc, which is disposed in the period Tc are continuous in the period T. When the generated drive signal VOUT is supplied to one end of the piezoelectric element 60, the medium amount of ink is ejected in the period Ta from the ejection section 600 corresponding to the piezoelectric element 60. The ink is not ejected in the periods Tb and Tc. As a result, in the period T, the medium amount of ink lands on the printing medium to form a medium dot.

When the latched print data corresponds to the "small dot", the drive signal selection circuit 200 generates the drive signal VOUT having a waveform in which the constant waveform with the voltage Vc, which is disposed in the period Ta, the trapezoidal waveform Bdp disposed in the period Tb, and the constant waveform with the voltage Vc, which is disposed in the period Tc are continuous in the period T. When the generated drive signal VOUT is supplied to one end of the piezoelectric element 60, the ink is not ejected in the period Ta. The small amount of ink is ejected in the period Tb from the ejection section 600 corresponding to the piezoelectric element 60. In the period Tc, the ink is not ejected. As a result, the small amount of ink lands on the printing medium in the period T to form a small dot.

When the latched print data corresponds to the "no recording", the drive signal selection circuit 200 generates the drive signal VOUT having a waveform in which the constant waveform with the voltage Vc, which is disposed in the period Ta, the constant waveform with the voltage Vc, which is disposed in the period Tb, and the trapezoidal waveform Cdp disposed in the period Tc are continuous in the period T. When the generated drive signal VOUT is supplied to one end of the piezoelectric element 60, in the period T, from the ejection section 600 corresponding to the piezoelectric element 60, the ink is not ejected in the periods Ta and Tb, and the ink in the vicinity of the nozzle opening portion is slightly vibrated, and the ink is not ejected in the period Tc. As a result, in the period T, the ink does not land on the printing medium and a dot is not formed.

Here, the constant waveform with the voltage Vc, which is supplied to the electrode 611 of the piezoelectric element 60 refers to a waveform configured by a voltage in which the previous voltage Vc is held by a capacitance component of the piezoelectric element 60 when the drive signal selection circuit 200 does not select any of the trapezoidal waveforms Adp, Bdp, and Cdp as the drive signal VOUT.

As described above, the drive signal selection circuit 200 generates the drive signal VOUT by switching whether or not to select the trapezoidal waveforms Adp, Bdp, and Cdp included in the drive signal COM based on the print data signal SI in the periods Ta, Tb, and Tc defined by the latch signal LAT and the change signal CH.

Here, the drive signal COM and the drive signal VOUT illustrated in FIGS. 3 and 4 are just examples. Various waveform combinations may be used in accordance with the physical properties of the ink to be supplied to the print head 20, the material of the printing medium to which the ink is ejected, and the like. The print head 20 that ejects the ink to a printing medium to form an image on the printing medium is an example of an ejection head.

Returning to FIGS. 1A and 1B, the power source circuit 110 in the control mechanism 10 generates and outputs voltages VHV and VDD. The voltage VHV is a DC voltage signal having a voltage value of, for example, 42 V, and is supplied to the components in the printing apparatus 1, as an amplification voltage in the drive signal output circuit 51, and an operating voltage of the drive signal selection circuit 200, and the like. The voltage VDD is a DC voltage signal having a voltage value of, for example, 3.3 V, and is supplied to the components in the printing apparatus 1, as a power source voltage of the control circuit 100 in the control mechanism 10, a control voltage of the drive signal selection circuit 200, and the like. That is, the power source circuit 110 generates various constant voltage signals used in the printing apparatus 1 and outputs the generated signals to the corresponding components. Therefore, the power source circuit 110 may generate and output signals having a plurality of voltage values other than the voltages VHV and VDD.

The power source circuit 110 generates a voltage Vt and outputs the voltage Vt to the voltage supply switching section 120. The voltage supply switching section 120 switches whether or not to supply the voltage Vt as a voltage Vheat to the medium dry-heating section 30 based on a switching signal HS input from the control circuit 100. That is, the voltage supply switching section 120 functions as a switch circuit of switching whether or not to supply electric power to the medium dry-heating section 30.

The medium dry-heating section 30 starts an operation by the voltage Vheat. The medium dry-heating section 30 dries the ink landed on the printing medium to fix the ink on the printing medium. That is, the medium dry-heating section 30 may have a configuration capable of outputting a heat amount to the extent that the ink landed on the printing medium is fixed. For example, the medium dry-heating section may be a circuit including a plurality of resistive elements that generate heat by a current flowing by the voltage Vheat being supplied. The medium dry-heating section may include a corona discharge generation circuit that generates corona discharge based on the voltage Vheat. The medium dry-heating section 30 that dries the ink ejected to the printing medium by heat is an example of a heat generation section.

The control circuit 100 generates an image acquisition signal ICP and outputs the image acquisition signal to the image detection section 40. The image detection section 40 acquires information on the surface state of the printing medium based on the image acquisition signal ICP, and outputs the information as an image information signal IS to the image determination section 130. Here, the information on the surface state of the printing medium, which is acquired by the image detection section 40, includes image information indicating information on the image formed on the surface of the printing medium and surface information indicating information on the surface of the printing medium before the image is formed on the surface of the printing medium. The image detection section 40 outputs the image information signal IS indicating the surface information and the image information signal IS indicating the image information to the image determination section 130.

Here, whether the image information signal IS output by the image detection section 40 indicates the surface information or the image information is defined by a timing at which the image acquisition signal ICP is input from the control circuit 100. Specifically, when the control circuit 100 outputs the image acquisition signal ICP to the image detection section 40 before the image is formed on the surface of the printing medium, the image detection section 40 outputs the surface information as the image information signal IS to the image determination section 130. When the image is formed on the surface of the printing medium, and then the control circuit 100 outputs the image acquisition signal ICP to the image detection section 40, the image detection section 40 outputs the image information as the image information signal IS to the image determination section 130. As described above, the image detection section 40 detects the image formed on the printing medium.

The image determination section 130 determines whether or not a problem has occurred in the plurality of ejection sections 600 in the print head 20 by comparing the image information signal IS input from the image detection section 40 with a reference image.

Specifically, the image determination section 130 includes a medium information storing portion 131, an acquisition image information storing portion 132, a reference image information storing portion 133, and an arithmetic operation section 134. When the surface information is input as the image information signal IS, the medium information storing portion 131 stores the surface information. When the image information is input as the image information signal IS, the acquisition image information storing portion 132 stores the image information. The reference image information storing portion 133 stores reference image information as a reference for comparison with the image acquired by the image detection section 40.

Firstly, the arithmetic operation section 134 corrects the color tone, stains, and the like of the printing medium, so as to correct the image information stored in the acquisition image information storing portion 132, based on the surface information stored in the medium information storing portion 131. Thus, the arithmetic operation section 134 calculates formed-image information on the image formed on the printing medium by the ink ejected from the print head 20. Secondly, the arithmetic operation section 134 compares the calculated formed-image information with the reference image information stored in the reference image information storing portion 133. The arithmetic operation section determines the state of the image formed on the printing medium or the state of the print head 20 that ejects the ink to the printing medium, based on the comparison result.

For example, when an ejection problem that the ink is not ejected has occurred in some of the plurality of ejection sections 600 in the print head 20, the ink is not ejected to the printing medium from the nozzle in which the ejection problem has occurred. Therefore, a part of the formed-image information calculated by the arithmetic operation section 134 is lost in comparison to the reference image information stored in the reference image information storing portion 133. In addition, when an ejection problem such as flight bending has occurred in the ink ejected from some of the plurality of ejection sections 600 in the print head 20, a portion of the formed-image information used as the reference by the arithmetic operation section 134 is distorted in comparison to the reference image information stored in the reference image information storing portion 133. That is, it is possible to detect an occurrence of an ejection problem of the ink ejected from the print head 20 in a manner that the image detection section 40 detects the surface information and the image information on an image formed on the printing medium, and the image determination section 130 calculates the formed-image information based on the surface information and the image information and compares the formed-image information with the reference image information.

The image determination section 130 outputs an ejection-section information signal NSS indicating the determination result, to the control circuit 100. The control circuit 100 performs processing such as correction of various control signals, stop of the operation, and notification of warning information, based on the ejection-section information signal NSS input from the image determination section 130.

Here, in the printing apparatus 1 illustrated in FIGS. 1A and 1B, the case where the image determination section 130 is provided in the control mechanism 10 is described, and the image determination section 130 may be configured integrally with the image detection section 40. The image detection section 40 may generate the formed-image information on the image formed on the printing medium by the ink ejected from the print head 20, in a manner that the image detection section 40 holds the potential generated when the surface information of the printing medium before the image is formed is acquired, and acquires the image information with the held potential as a reference. As such an image detection section 40, a line sensor in which a plurality of image detection elements are provided in a row, for example, a contact image sensor (CIS) type line sensor may be used.

2. Structure of Printing Apparatus

Next, the structure of the printing apparatus 1 in the embodiment will be described. The printing apparatus 1 in the embodiment is a printing apparatus 1 that requires higher-definition print quality. Specifically, a photo printer that performs printing of photographs will be described as an example.

Figure 5:
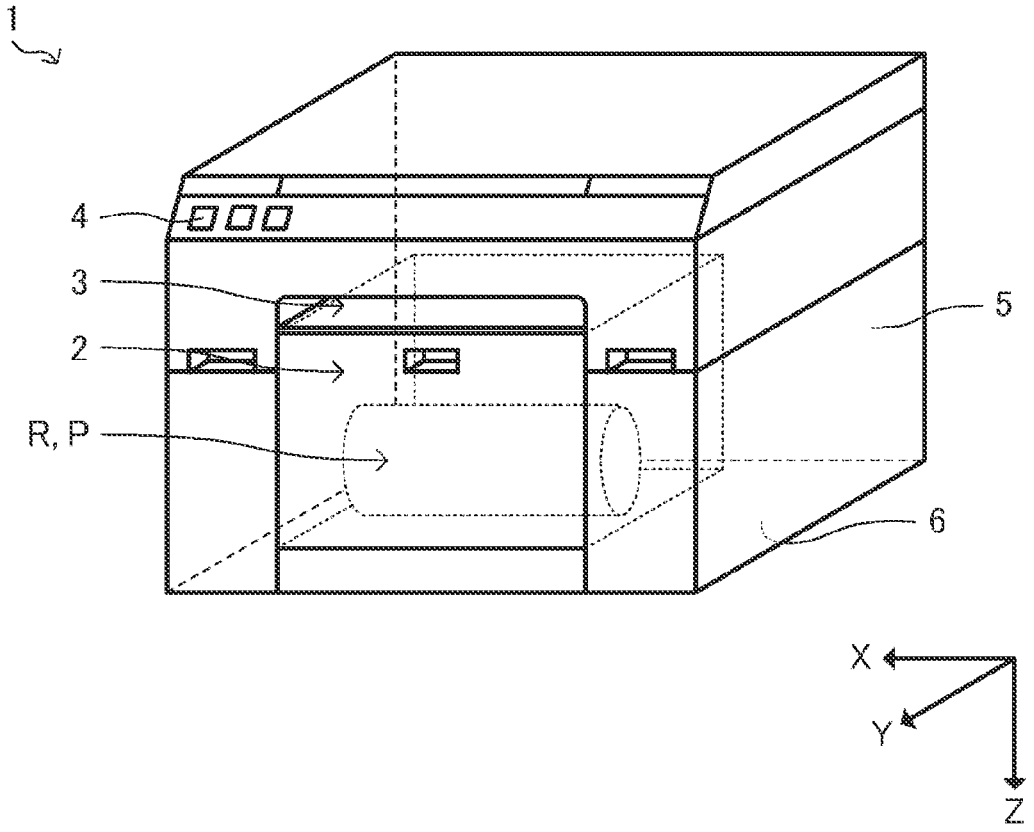
FIG. 5 is a diagram illustrating an external configuration of the printing apparatus.
Figure 6:
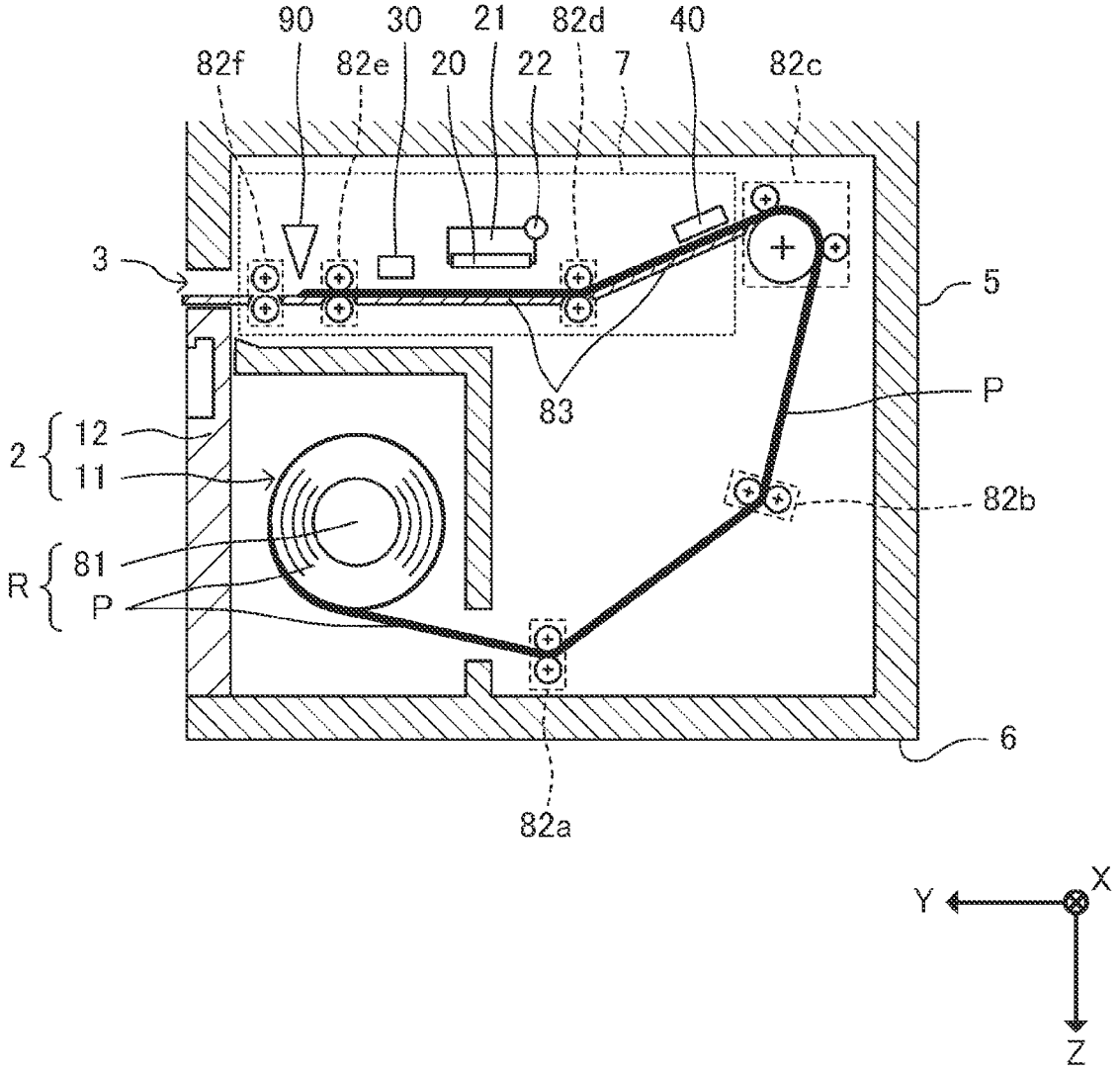
FIG. 6 is a diagram illustrating an internal configuration of the printing apparatus.
Figure 7:
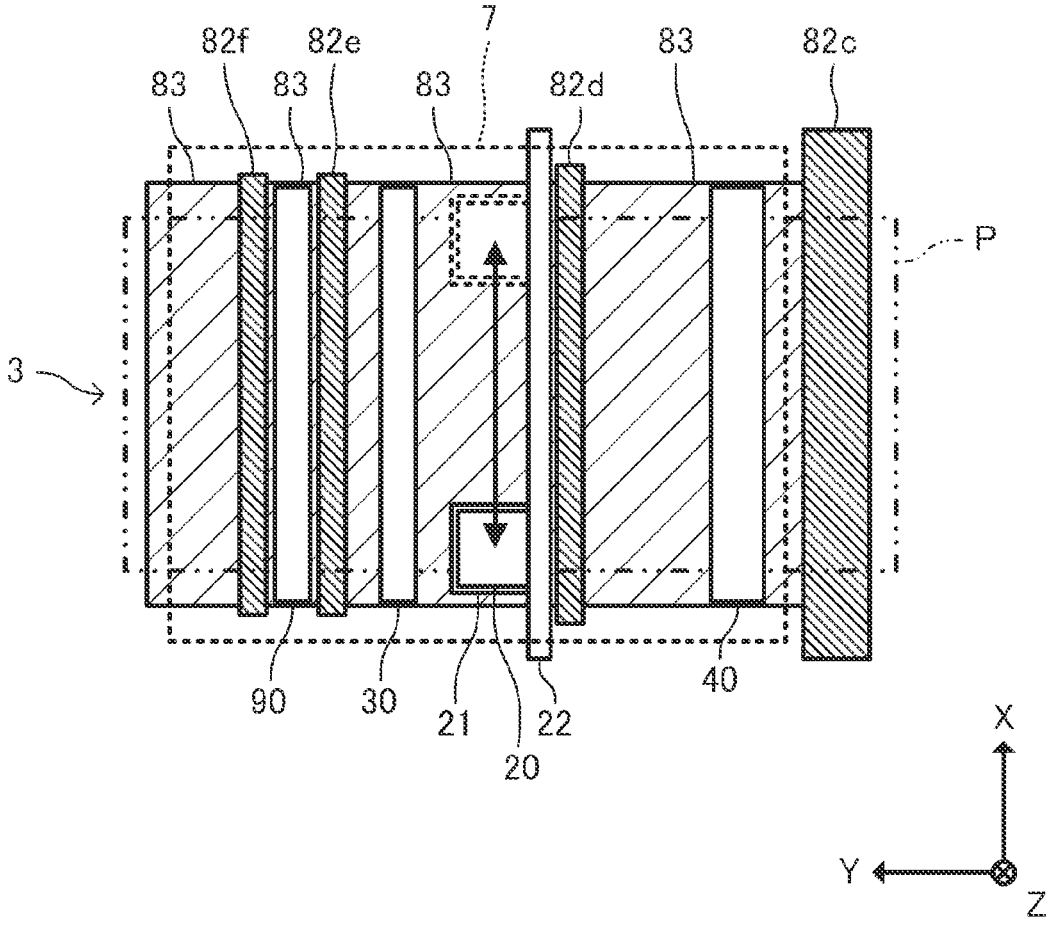
FIG. 7 is a diagram illustrating a configuration of an image forming section.

The structure of the printing apparatus 1 in the embodiment will be described with reference to FIGS. 5 to 7. FIG. 5 is a diagram illustrating an external configuration of the printing apparatus 1. FIG. 6 is a diagram illustrating an internal configuration of the printing apparatus 1. FIG. 7 is a diagram illustrating the configuration of an image forming section 7. Here, in the following description, description will be made with arrows indicating an X-direction, a Y-direction, and a Z-direction that intersect with each other. The starting point side of the arrow indicating the X-direction in the drawings may be referred to as a −X side, and the tip side may be referred to as a +X side. The starting point side of the arrow indicating the Y-direction may be referred to as a −Y side, and the tip side may be referred to as a +Y side. The starting point side of the arrow indicating the Z-direction may be referred to as a −Z side, and the tip side may be referred to as a +Z side. Although description will be made on the assumption that the X-direction, the Y-direction, and the Z-direction are axes that are orthogonal to each other, the description is not limited to the various components forming the printing apparatus 1 being arranged orthogonally.

As illustrated in FIG. 5, the printing apparatus 1 includes a housing 5, a medium accommodation portion 2, a discharge port 3, and an operation section 4. The medium accommodation portion 2 accommodates a columnar roll body R around which a medium P is wound as the printing medium. The discharge port 3 is provided for the medium P being discharged from the housing 5. The operation section 4 is provided for inputting a command when a user operates the printing apparatus 1. The printing apparatus 1 may include a coupling terminal or a wireless communication module (not illustrated) for performing a communication with a host computer provided outside the printing apparatus 1. An external memory such as a USB may be attachable to the printing apparatus 1. The printing apparatus 1 transports the roll-shaped medium P accommodated in the medium accommodation portion 2, and forms a desired image on the surface of the medium P and discharges the medium from the discharge port 3, based on the operation of the operation section 4 or a signal input from the host computer. Here, in FIG. 5, a bottom surface 6 which is a surface of the housing 5 on the +Z side and is located at the bottom of the housing 5 in the gravity direction corresponds to an installation surface on which the printing apparatus 1 may be installed when the printing apparatus 1 is used.

As illustrated in FIG. 6, the medium accommodation portion 2 has an opening/closing portion 12 and a medium accommodation space 11. The roll body R includes a core material portion 81 and a medium P wound around the core material portion 81. The roll body R is accommodated in the medium accommodation space 11 through the opening/closing portion 12, and the core material portion 81 is held in a rotatable state in the medium accommodation space 11. The core material portion 81 is coupled to a drive motor (not illustrated). A rotational force is applied to the core material portion 81 by driving the drive motor. With the rotational force applied to the core material portion 81, the medium P is wound around the core material portion 81, or the medium P wound around the core material portion 81 is fed out. Specifically, in the printing apparatus 1 illustrated in FIG. 6, when a rotational force is applied clockwise to the core material portion 81 by driving the drive motor, the medium P is wound around the core material portion 81. When the rotational force is applied counterclockwise to the core material portion 81 by driving the drive motor, the medium P wound around the core material portion 81 is fed out.

The medium P fed out from the roll body R is transported to the image forming section 7 in a state of being sandwiched by sandwiching rollers 82*a*, 82*b*, and 82*c*. Specifically, the medium P fed out from the roll body R accommodated in the medium accommodation portion 2 is held in a state of being sandwiched between a pair of rollers included in the sandwiching roller 82*a*, and is transported to the sandwiching roller 82*b* by the rotational force generated in the sandwiching roller 82*a*. In the sandwiching roller 82*b*, the medium P is held in a state of being sandwiched between a pair of rollers included in the sandwiching roller 82*b*, and is transported to the sandwiching roller 82*c* by the rotational force generated in the sandwiching roller 82*b*. In the sandwiching roller 82*c*, the medium P is held in a state of being sandwiched between a plurality of rollers included in the sandwiching roller 82*c*, and is transported to the image forming section 7 by the rotational force generated in the sandwiching roller 82*c*.

Here, one of the pair of rollers included in each of the sandwiching rollers 82*a* and 82*b* may be coupled to a drive motor (not illustrated). That is, one of the pair of rollers included in each of the sandwiching rollers 82*a* and 82*b* in the embodiment may be a driving roller that rotates with driving of the drive motor. The other of the pair of rollers included in each of the sandwiching rollers 82*a* and 82*b* may be a driven roller that rotates by driving the driving roller. Similarly, at least one of the plurality of rollers included in the sandwiching roller 82*c* may be a driving roller that is coupled to a drive motor (not illustrated) and rotates with driving of the drive motor. The remaining rollers of the plurality of rollers included in the sandwiching roller 82*c* may be driven rollers that rotate by driving the driving roller. Here, the number of driving rollers included in each of the sandwiching rollers 82*a*, 82*b*, and 82*c* may be any value as long as the medium P can be stably transported in the printing apparatus 1. For example, some rollers of the sandwiching rollers 82*a*, 82*b*, and 82*c* may be configured only by driven rollers.

As illustrated in FIGS. 6 and 7, the image forming section 7 includes the image detection section 40, the print head 20, the medium dry-heating section 30, the medium cutting section 90, sandwiching rollers 82*d*, 82*e*, and 82*f*, and a medium holding portion 83. The image forming section 7 forms a desired image on the medium P by ejecting the ink to the medium P transported through the sandwiching roller 82*c*. In addition, the image forming section discharges the medium P on which the desired image is formed, to the outside of the housing 5 through the discharge port 3.

As illustrated in FIGS. 6 and 7, the medium P transported to the image forming section 7 through the sandwiching roller 82*c* is transported to the discharge port 3 in a state of being sandwiched between the sandwiching rollers 82*d*, 82*e*, and 82*f*. Specifically, the medium P transported to the image forming section 7 is held in a state of being sandwiched between a pair of rollers included in the sandwiching roller 82*d*, and is transported to the sandwiching roller 82*e* by the rotational force generated in the sandwiching roller 82*d*. In the sandwiching roller 82*e*, the medium P is held in a state of being sandwiched between a pair of rollers included in the sandwiching roller 82*e*, and is transported to the sandwiching roller 82*f* by the rotational force generated in the sandwiching roller 82*e*. In the sandwiching roller 82*f*, the medium P is held in a state of being sandwiched between a pair of rollers included in the sandwiching roller 82*f*, and is transported to the discharge port 3 by the rotational force generated in the sandwiching roller 82*f*.

The medium holding portion 83 for supporting the medium P is located between the sandwiching roller 82*c* and the sandwiching roller 82*d*, between the sandwiching roller 82*d* and the sandwiching roller 82*e*, between the sandwiching roller 82*e* and the sandwiching roller 82*f*, and between the sandwiching roller 82*f* and the discharge port 3. The medium P is held by the medium holding portion 83 in the image forming section 7, and thus it is possible to improve the flatness of the medium P in the image forming section 7.

Here, one of the pair of rollers included in each of the sandwiching rollers 82*d*, 82*e*, and 82*f* may be coupled to a drive motor (not illustrated). That is, one of the pair of rollers included in each of the sandwiching rollers 82*d*, 82*e*, and 82*f* in the embodiment may be a driving roller that rotates with driving of the drive motor. The other of the pair of rollers included in each of the sandwiching rollers 82*d*, 82*e*, and 82*f* may be a driven roller that rotates by driving the driving roller. The number of driving rollers included in each of the sandwiching rollers 82*d*, 82*e*, and 82*f* may be any value as long as the medium P can be stably transported while securing the flatness of the surface of the medium P, in the printing apparatus 1. For example, some rollers of the sandwiching rollers 82*d*, 82*e*, and 82*f* may be configured only by driven rollers.

As described above, the medium P contained in the roll body R accommodated in the medium accommodation portion 2 is transported to the discharge port 3 in a state of being held by the sandwiching rollers 82*a* to 82*f* and the medium holding portion 83. In the following description, a path through which the medium P is transported from the medium accommodation portion 2 toward the discharge port 3 is referred to as a transport path HK. Here, the sandwiching rollers 82*a* to 82*f* for transporting the provided medium P, and the medium holding portion 83 along the transport path HK in which the medium P is transported from the medium accommodation portion 2 to the discharge port 3, and the drive motor (not illustrated) that applies the rotational force to the sandwiching rollers 82*a* to 82*f* correspond to the medium transport section 80 illustrated in FIGS. 1A and 1B. The medium accommodation portion 2 that accommodates the medium P is an example of a medium accommodation portion. The discharge port 3 for discharging the medium P to the outside of the printing apparatus 1 is an example of a medium discharge port.

In the image forming section 7, the image detection section 40, the print head 20, the medium dry-heating section 30, and the medium cutting section 90 are located along the transport path HK. Specifically, the image detection section 40 is located between the sandwiching roller 82*c* and the sandwiching roller 82*d* along the transport path HK. The image detection section 40 detects the image formed on the medium P transported along the transport path HK as described above.

The print head 20 is located between the sandwiching roller 82*d* and the sandwiching roller 82*e* along the transport path HK, and is located on the sandwiching roller 82*d* side. That is, the print head 20 is located on the downstream of the image detection section 40 in the transport direction of the medium P transported along the transport path HK. The print head 20 is mounted in the carriage 21 in which the carriage 21 freely reciprocates in the X-direction along a carriage guide shaft 22. The carriage 21 moves back and forth in the X-direction along the carriage guide shaft 22 under the control of the carriage movement controller 71 illustrated in FIGS. 1A and 1B, and thus the print head 20 mounted in the carriage 21 moves back and forth in the X-direction. It is possible to eject the ink to a desired position in the width direction of the transported medium P, by the print head 20 ejecting the ink to the medium P in synchronization with the back and forth movement of the carriage 21.

The medium dry-heating section 30 is located between the sandwiching roller 82*d* and the sandwiching roller 82*e* along the transport path HK, and is located on the sandwiching roller 82*e* side. That is, the medium dry-heating section 30 is located on the downstream of the print head 20 in the transport direction of the medium P transported along the transport path HK. The medium dry-heating section 30 dries the ink ejected from the print head 20 to the medium P with heat.

The medium cutting section 90 is located between the sandwiching roller 82*e* and the sandwiching roller 82*f* along the transport path HK. That is, the medium cutting section 90 is located on the downstream of the medium dry-heating section 30 in the transport direction of the medium P transported along the transport path HK. The medium cutting section 90 cuts the medium P on which the image is formed by fixing the ejected ink, to a desired size. That is, the medium cutting section 90 cuts the medium P formed as the roll body R by being wound around the core material portion 81, into a single sheet. The medium P cut to a desired size by the medium cutting section 90 is discharged from the discharge port 3 through the sandwiching roller 82*f*.

As described above, the printing apparatus 1 includes the medium accommodation portion 2 that accommodates the medium P, the discharge port 3 for discharging the medium P to the outside of the apparatus, the medium transport section 80 that transports the medium P along the transport path HK from the medium accommodation portion 2 toward the discharge port 3, the print head 20 that ejects the ink to the medium P to form an image on the medium P, the medium dry-heating section 30 that dries the ink ejected to the medium P with heat, and the image detection section 40 that detects the image formed on the medium P. The print head 20, the medium dry-heating section 30, and the image detection section 40 are provided along the transport path HK. The image detection section 40 is located between the print head 20 and the medium accommodation portion 2 along the transport path HK. The print head 20 is located between the image detection section 40 and the discharge port 3 along the transport path HK. The print head 20 is located between the medium dry-heating section 30 and the image detection section 40 along the transport path HK.

As described above, the print head 20, the medium dry-heating section 30, and the image detection section 40 are provided along the transport path HK. Since the print head 20 is located between the medium dry-heating section 30 and the image detection section 40 along the transport path HK, the print head 20 reduces the influence of heat generated by the medium dry-heating section 30 on the image detection section 40. As a result, the possibility that the characteristics of the image detection section 40 change by the heat generated by the medium dry-heating section 30 is reduced, and thus it is possible to improve the detection accuracy of the surface state of the medium P in the image detection section 40.

Therefore, even when the ambient temperature of the medium dry-heating section 30 is higher than the ambient temperature of the image detection section 40 in a case where the medium dry-heating section 30 dries the ink ejected to the medium P, the print head 20 causes the possibility that the heat generated by the medium dry-heating section 30 is applied to the image detection section 40 to be reduced. Thus, it is possible to reduce the possibility that the characteristics of the image detection section 40 changes by the heat generated by the medium dry-heating section 30. As a result, it is possible to improve the detection accuracy of the surface state of the medium P in the image detection section 40.

As illustrated in FIG. 7, the length of the print head 20 in a direction along the transport path HK is preferably longer than the length of the medium dry-heating section 30 in the direction along the transport path HK. The length of the print head 20 in the direction along the transport path HK is preferably longer than the length of the image detection section 40 in the direction along the transport path HK. Thus, the print head 20 can more efficiently block the heat generated by the medium dry-heating section 30. As a result, the possibility that the heat generated by the medium dry-heating section 30 is applied to the image detection section 40 is more reduced. Therefore, it is possible to more reduce the possibility that the characteristics of the image detection section 40 change by the heat generated by the medium dry-heating section 30, and thus it is possible to improve the detection accuracy of the surface information of the medium P in the image detection section 40.

As illustrated in FIG. 6, the shortest distance between the medium P and the image detection section 40 is preferably shorter than the shortest distance between the medium P and the print head 20. Therefore, it is possible to reduce the possibility that the ejection characteristics of the ink are deteriorated by the medium P coming into contact with the print head 20, while improving the detection accuracy of the surface information of the medium P by the image detection section 40.

Specifically, it is possible to detect the image information on the surface of the medium P, which can be acquired by the image detection section 40, with higher accuracy, by reducing the shortest distance between the medium P and the image detection section 40. That is, the shortest distance between the image detection section 40 and the medium P is preferably shorter than the focal length of a line sensor configured as the image detection section 40. Specifically, the image detection section 40 is positioned so that the shortest distance between the image detection section 40 and the medium P is less than 1 mm, preferably about 0.5 mm, and thus it is possible to improve the detection accuracy of the surface information of the medium P by the image detection section 40.

On the other hand, when the shortest distance between the medium P and the print head 20 is reduced, the transported medium P may come into contact with the print head 20. When the medium P comes into contact with the print head 20, there is a concern that the paper pieces of the medium P adhere to the vicinity of the nozzle 651 to deteriorate the ejection characteristics of the ink, and the medium P comes into contact with the nozzle 651 to deteriorate the ejection characteristics of the ink by the damage of the nozzle 651 and the ejection section 600. Therefore, the shortest distance between the medium P and the print head 20 is preferably set to the extent that the possibility that the ink ejected from the print head 20 scatters in the housing 5 and adheres to the medium P can be reduced. Specifically, when the print head 20 is located so that the shortest distance between the image detection section 40 and the medium P is from 1 mm to 2 mm, preferably, about 1.3 mm, it is possible to reduce the possibility that the ink scatters in the housing 5 and the medium P is contaminated by the scattering ink, while reducing the possibility that the ejection characteristics of the ink are deteriorated by the medium P coming into contact with the print head 20.

In addition, as illustrated in FIG. 6, in the housing 5 that accommodates the print head 20 and the image detection section 40, it is preferable that the print head 20 be located in the direction of gravity of the printing apparatus 1 with respect to the image detection section 40 and be located in the vicinity of the bottom surface 6 that is the installation surface on which the printing apparatus 1 may be installed, and intersects with the Z-direction being the ejection direction in which the ink is ejected to the medium P from the print head 20. In other words, the shortest distance between the print head 20 and the bottom surface 6 is preferably shorter than the shortest distance between the image detection section 40 and the bottom surface 6.

When the ink ejected from the print head 20 scatters in the housing 5 of the printing apparatus 1, the scattering ink drifts in the vicinity of the bottom surface 6 in a weight direction with the elapse of time. In this case, it is possible to reduce the possibility that the ink scattering in the housing 5 adheres to the surface of the medium P, which is detected by the image detection section 40, by locating the image detection section 40 that detects the surface image of the medium P above the print head 20 that ejects the ink. That is, it is possible to improve the acquisition accuracy of the surface information of the medium P, which is acquired by the image detection section 40 before the image is formed on the medium P.

3. Operation of Printing Apparatus

As described above, in the printing apparatus 1 in the embodiment, the print head 20 ejects the ink to the medium P to form a desired image on the medium P, the image detection section 40 acquires information on the surface state of the medium P, and the image determination section 130 detects the occurrence of the ejection problem of the print head 20 based on the acquired information on the surface state. That is, the printing apparatus 1 in the embodiment has two operation modes of an image forming mode and a medium information acquisition mode. In the image forming mode, the print head 20 ejects the ink to the medium P to form a desired image on the medium P. In the medium information acquisition mode, the image detection section 40 acquires the information on the surface state of the medium P. The details of the operations of the image forming mode and the medium information acquisition mode of the printing apparatus 1 will be described below.

Figure 8:
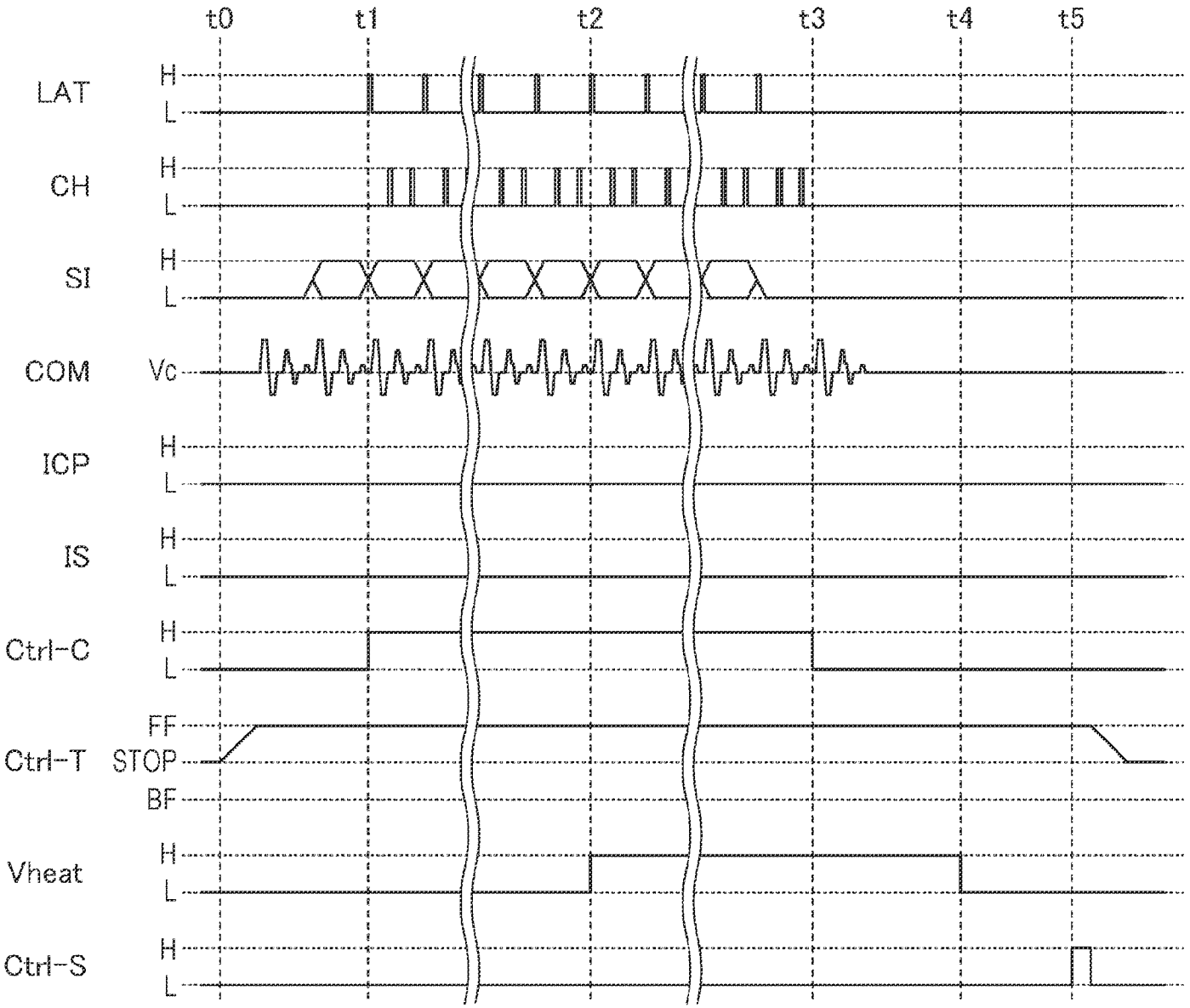
FIG. 8 is a diagram illustrating an operation of the printing apparatus in an image forming mode.

Firstly, the details of the image forming mode will be described with reference to FIG. 8. FIG. 8 is a diagram illustrating the operation of the printing apparatus 1 in the image forming mode.

When a print request for forming a desired image on a medium P is input to the printing apparatus 1 through the host computer or the operation section 4, the printing apparatus 1 starts transport of the medium P at a time point t0. Specifically, at the time point t0, the control circuit 100 outputs the control signal Ctrl-T for transporting the medium P from the medium accommodation portion 2 toward the discharge port 3, to the medium transport section 80. Thus, the transport of the medium P is started in a direction from the medium accommodation portion 2 toward the discharge port 3. Here, in FIGS. 8 and 9, the voltage level of the control signal Ctrl-T output by the control circuit 100 when the medium transport section 80 transports the medium P from the medium accommodation portion 2 toward the discharge port 3 along the transport path HK is indicated as FF (forward feed). The voltage level of the control signal Ctrl-T output by the control circuit 100 when the medium transport section 80 transports the medium P from the discharge port 3 to the medium accommodation portion 2 along the transport path HK is indicated by BF (back feed). Further, the voltage level of the control signal Ctrl-T output by the control circuit 100 when the medium transport section 80 stops the transport of the medium P is indicated as Stop.

In a period from the time point t0 to a time point t1 when the transport of the medium P starts, the drive circuit 50 starts an output of the drive signal COM to the print head 20, and the control circuit 100 starts an output of the print data signal SI to the print head 20. That is, in the period from the time points t0 to t1, the printing apparatus 1 performs an initial operation for performing printing processing of forming a desired image on the medium P.

The time point t1 is a timing at which the medium P transported by the medium transport section 80 is transported below the print head 20 in the direction along the Z-direction, or a timing immediately before the medium P is transported below the print head 20 in the direction along the Z-direction. In addition, the time point t1 is a timing at which the printing processing is started on the medium P. At the time point t1, the control circuit 100 outputs the latch signal LAT having an H-level to the print head 20. Thus, the print data signal SI held in the drive signal selection circuit 200 corresponding to the m ejection sections 600 of the print head 20 is latched all at once. As a result, the drive signal selection circuit 200 starts an output of the drive signal VOUT defined by the print data signal SI. At the time point t1, the control circuit 100 outputs the control signal Ctrl-C having an H-level to the carriage movement controller 71. Thus, the carriage movement controller 71 starts controlling of the back and forth movement in the width direction of the medium P of the carriage 21 in which the print head 20 is mounted. The width direction is the direction along the X-direction, illustrated in FIG. 7.

That is, at the time point t1, the printing apparatus 1 starts ejection of the ink having an amount based on the print data signal SI, to the medium P, and starts controlling of the back and forth movement of the carriage 21 (in which the print head 20 is mounted) in the width direction of the of the medium P. At the time point t1, the medium transport section 80 continuously transports the medium P in the direction from the medium accommodation portion 2 toward the discharge port 3. That is, the printing apparatus 1 starts the printing processing of forming a desired image on the medium P by transporting the medium P at the time point t1 and ejecting the ink from the print head 20 mounted in the carriage 21 at a predetermined timing.

After the printing apparatus 1 starts the printing processing at the time point t1, the control circuit 100 continuously performs the printing processing by outputting the latch signal LAT at a timing corresponding to the position information signal CP indicating the position information of the carriage 21, which is input from the carriage position detection section 70, and outputting the change signal CH for defining the waveform selection of the drive signal COM in the drive signal selection circuit 200 and the print data signal SI at a predetermined timing.

A time point t2 is a timing at which the medium P transported by the medium transport section 80 is transported below the medium dry-heating section 30 in the direction along the Z-direction, or a timing immediately before the medium P is transported below the medium dry-heating section 30 in the direction along the Z-direction.

In addition, the time point t2 is a timing at which image fixing processing to the medium P is started by applying heat to the ink landed on the medium P. At the time point t2, the control circuit 100 outputs the switching signal HS having an H-level to the voltage supply switching section 120. Thus, the voltage supply switching section 120 outputs the voltage Vt input from the power source circuit 110 to the medium dry-heating section 30 as the voltage Vheat. The medium dry-heating section 30 generates heat based on the voltage Vheat to dry the ink landed on the medium P, so that the ink landed on the medium P is fixed on the medium P.

A time point t3 is a timing at which forming of an image on the medium P by the ink ejected from the print head 20 is completed in the printing apparatus 1 and a timing at which the printing processing of forming a desired image by ejecting the ink to the medium P is ended. At the time point t3, the control circuit 100 stops the output of the change signal CH. At the time point t3, the control circuit 100 sets the control signal Ctrl-C to be output to the carriage movement controller 71 to have an L-level. Thus, the carriage movement controller 71 stops the back and forth movement of the carriage 21 in which the print head 20 is mounted. When the back and forth movement of the carriage 21 is stopped, the input of the position information signal CP from the carriage position detection section 70 to the control circuit 100 is stopped. As a result, the control circuit 100 stops the output of the latch signal LAT. Therefore, the drive signal selection circuit 200 stops the output of the drive signal VOUT, and as a result, the print head 20 stops the ink ejection. That is, the printing processing in the printing apparatus 1 is completed.

Even after the printing processing of ejecting the ink from the print head 20 is completed, the control circuit 100 continues the output of the control signal Ctrl-T for transporting the medium P to the discharge port 3, to the medium transport section 80. At the same time, the switching signal HS having an H-level is output to the voltage supply switching section 120. Thus, the transport of the medium P and the image fixing processing to the medium P are consecutively performed. Then, a time point t4 is a timing at which all the images formed on the medium P have passed through the medium dry-heating section 30 in the direction along the Z-direction. At the time point t4, the control circuit 100 outputs the switching signal HS having an L-level to the voltage supply switching section 120. Accordingly, the image fixing processing is completed.

Then, at a time point t5, the control circuit 100 outputs the control signal Ctrl-S having an H-level for cutting the medium P to a predetermined size, to the medium cutting section 90. The time point t5 is a timing at which a cutting point for cutting the medium P transported by the medium transport section 80 to a predetermined size is transported below the medium cutting section 90 in the direction along the Z-direction. Thus, the medium P is cut into a predetermined size. The medium P cut at the time point t5 is transported to the discharge port 3 by the medium transport section 80. As a result, the medium P on which the desired image is formed and which is cut to a predetermined size is discharged from the discharge port 3. Then, the control circuit 100 outputs the control signal Ctrl-T for stopping the transport of the medium P to the medium transport section 80.

As described above, when the printing apparatus 1 is in the image forming mode in which the ink is ejected from the print head 20 to the medium P to form a desired image on the medium P, the medium transport section 80 transports the medium P from the medium accommodation portion 2 to the discharge port 3, the print head 20 ejects the ink to the medium P, and the medium dry-heating section 30 dries the ink ejected on the medium P. Such an image forming mode is an example of a first mode.

Figure 9:
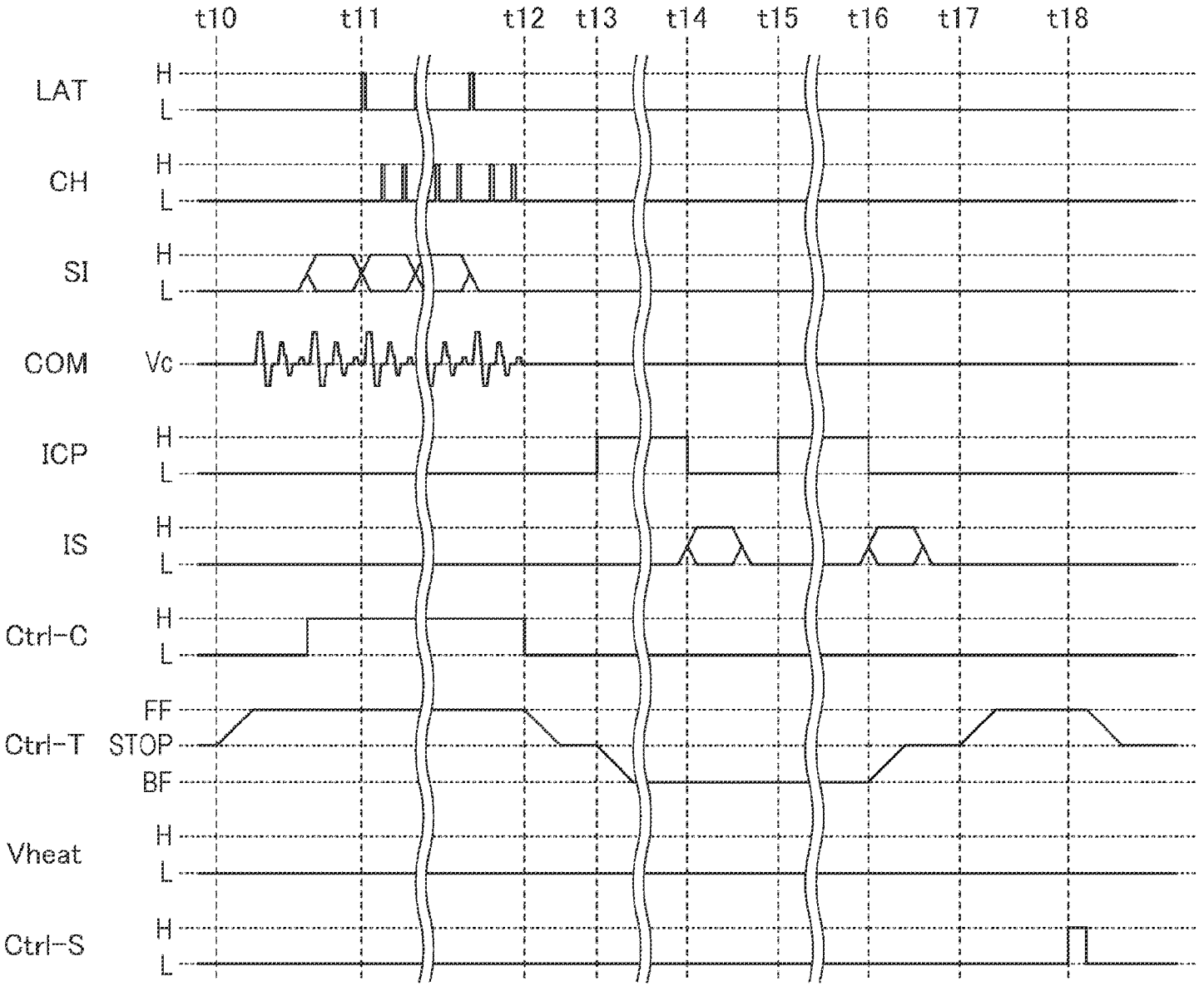
FIG. 9 is a diagram illustrating an operation of the printing apparatus in an image information acquisition mode.

Next, the details of the medium information acquisition mode will be described with reference to FIG. 9. FIG. 9 is a diagram illustrating the operation of the printing apparatus 1 in the image information acquisition mode.

When an inspection request for inspecting whether or not the print head 20 has a problem is input to the printing apparatus 1 through the host computer or the operation section 4, the printing apparatus 1 starts the transport of the medium P at a time point t10. Specifically, at the time point t10, the control circuit 100 outputs the control signal Ctrl-T for transporting the medium P from the medium accommodation portion 2 toward the discharge port 3, to the medium transport section 80. Thus, the transport of the medium P is started in the direction from the medium accommodation portion 2 toward the discharge port 3.

In a period from the time point t10 to a time point t11 when the transport of the medium P starts, the drive circuit 50 starts to output the drive signal COM to the print head 20, and the control circuit 100 starts to output the print data signal SI to the print head 20. In this case, the print data signal SI output by the control circuit 100 includes data for forming an inspection image for inspecting whether or not the print head 20 has a problem. That is, in the period from the time points t10 to t11, the printing apparatus 1 performs an initial operation for performing printing processing of forming the inspection image on the medium P.

The time point t11 is a timing at which the medium P transported by the medium transport section 80 is transported below the print head 20 in the direction along the Z-direction, or a timing immediately before the medium P is transported below the print head 20 in the direction along the Z-direction. In addition, the time point t11 is a timing at which the printing processing is started on the medium P. At the time point t11, the control circuit 100 outputs the latch signal LAT having an H-level to the print head 20. Thus, the print data signal SI held in the drive signal selection circuit 200 corresponding to the m ejection sections 600 of the print head 20 is latched all at once. As a result, the drive signal selection circuit 200 starts an output of the drive signal VOUT defined by the print data signal SI. At the time point t11, the control circuit 100 outputs the control signal Ctrl-C having an H-level to the carriage movement controller 71. Thus, the carriage movement controller 71 starts controlling of the back and forth movement in the width direction of the medium P of the carriage 21 in which the print head 20 is mounted. The width direction is the direction along the X-direction, illustrated in FIG. 7.

That is, at the time point t11, the printing apparatus 1 starts ejection of the ink having an amount based on the print data signal SI, to the medium P, and starts controlling of the back and forth movement of the carriage 21 (in which the print head 20 is mounted) in the width direction of the of the medium P. At the time point t11, the medium transport section 80 continuously transports the medium P in the direction from the medium accommodation portion 2 toward the discharge port 3. That is, the printing apparatus 1 starts the printing processing of forming the inspection image on the medium P by transporting the medium P at the time point t11 and ejecting the ink from the print head 20 mounted in the carriage 21 at a predetermined timing.

After the printing apparatus 1 starts the printing processing at the time point t11, the control circuit 100 continuously performs the printing processing by outputting the latch signal LAT at a timing corresponding to the position information signal CP indicating the position information of the carriage 21, which is input from the carriage position detection section 70, and outputting the change signal CH for defining the waveform selection of the drive signal COM in the drive signal selection circuit 200 and the print data signal SI at a predetermined timing.

A time point t12 is a timing at which forming of an inspection image on the medium P by the ink ejected from the print head 20 is completed in the printing apparatus 1 and a timing at which the printing processing of forming the inspection image by ejecting the ink to the medium P is ended. At the time point t12, the control circuit 100 stops the output of the change signal CH. At the time point t12, the control circuit 100 sets the control signal Ctrl-C to be output to the carriage movement controller 71 to have an L-level. Thus, the carriage movement controller 71 stops the back and forth movement of the carriage 21 in which the print head 20 is mounted. When the back and forth movement of the carriage 21 is stopped, the input of the position information signal CP from the carriage position detection section 70 to the control circuit 100 is stopped. As a result, the control circuit 100 stops the output of the latch signal LAT. Therefore, the drive signal selection circuit 200 stops the output of the drive signal VOUT, and as a result, the print head 20 stops the ink ejection. That is, the printing processing of the inspection image in the printing apparatus 1 is completed.

After the printing processing is ended at the time point t12, and then the printing processing of the inspection image is ended, the control circuit 100 outputs the control signal Ctrl-T for stopping the transport of the medium P to the medium transport section 80. Thus, the transport of the medium P is stopped from the medium accommodation portion 2 toward the discharge port 3. At a time point t13, the control circuit 100 outputs the control signal Ctrl-T for transporting the medium P from the discharge port 3 toward the medium accommodation portion 2, to the medium transport section 80. Thus, the transport of the medium P is started from the discharge port 3 toward the medium accommodation portion 2. At a time point t13, the control circuit 100 outputs an image acquisition signal ICP having an H-level to the image detection section 40. Thus, the image detection section 40 acquires information on the surface state of the medium P transported between the image detection section 40 and the medium holding portion 83.

Here, as described above, the image detection section 40 is located between the print head 20 and the medium accommodation portion 2 along the transport path HK. The print head 20 is located between the image detection section 40 and the discharge port 3 along the transport path HK. In other words, the image detection section 40 is located on the upstream of the print head 20 in the transport path HK in which the medium P is transported from the medium accommodation portion 2 toward the discharge port 3. Therefore, at the time point t13, the ink is not ejected to the surface of the medium P transported between the image detection section 40 and the medium holding portion 83. That is, at the time point t13, the image detection section 40 detects the above-described surface information which is information on the surface state of the medium P before the image is formed.

Then, the control circuit 100 sets the image acquisition signal ICP to be output to the image detection section 40 to have an L-level at any time point t14 at which the medium P is transported between the image detection section 40 and the medium holding portion 83 without forming an image on the surface. Thus, the image detection section 40 stops detection of the surface information on the surface state of the medium P before the image is formed. The surface information of the medium P acquired by the image detection section 40 is output to the image determination section 130 as the image information signal IS, and is stored by the medium information storing portion 131 in the image determination section 130.

Even after the time point t14 at which the image detection section 40 stops the detection of the surface information being the information on the surface state of the medium P before the image is formed, the medium transport section 80 continuously transports the medium P in the direction from the discharge port 3 toward the medium accommodation portion 2.

A time point t15 is a timing at which the medium transport section 80 transports the medium P in the direction from the discharge port 3 toward the medium accommodation portion 2, and thus an inspection image-formed portion at which an inspection image is formed on the medium P is transported below the image detection section 40 in the direction along the Z-direction. At the time point t15, the medium P on which the inspection image is formed on the surface is transported between the image detection section 40 and the medium holding portion 83, so that the control circuit 100 outputs the image acquisition signal ICP having an H-level to the image detection section 40. Thus, the image detection section 40 starts acquisition of image information on the surface of the medium P on which the inspection image is formed, and which is transported between the image detection section 40 and the medium holding portion 83.

Then, the control circuit 100 sets the image acquisition signal ICP to be output to the image detection section 40 to have an L-level at any timing at which the medium P on which the inspection image is formed on the surface is transported between the image detection section 40 and the medium holding portion 83 or at a time point t16 being a timing at which the transport of the medium P on which the inspection image is formed on the surface, between the image detection section 40 and the medium holding portion 83 is completed. Thus, the image detection section 40 stops the detection of the image information being the information on the surface state of the medium P before the image is formed. The surface information of the medium P acquired by the image detection section 40 is output to the image determination section 130 as the image information signal IS, and is stored by the acquisition image information storing portion 132 in the image determination section 130.

At a time point t16, after the image detection section 40 outputs the image information signal IS to the image determination section 130, the control circuit 100 outputs the control signal Ctrl-T for stopping the transport of the medium P to the medium transport section 80.

As described above, the image determination section 130 uses the surface information which is acquired in a period from the time point t13 to the time point t14 and is stored in the medium information storing portion 131 in the image determination section 130, so as to correct the image information which is acquired in a period from the time point t15 to the time point t16 and is stored in the acquisition image information storing portion 132 in the image determination section 130. Thus, the formed-image information on the image formed by the ink ejected from the print head 20 is calculated. The image determination section 130 compares the formed-image information on the image formed by the ink ejected from the print head 20 and the reference image information stored in the reference image information storing portion 133, so as to determine the state of the image formed on the medium P and the state of the print head 20 that ejects the ink to the medium P. Then, the image determination section outputs the ejection-section information signal NSS indicating the determination result to the control circuit 100.

At a time point t17, the control circuit 100 outputs the control signal Ctrl-T for transporting the medium P from the medium accommodation portion 2 toward the discharge port 3, to the medium transport section 80. Thus, the transport of the medium P is started in the direction from the medium accommodation portion 2 toward the discharge port 3. At a time point t18, the control circuit 100 outputs the control signal Ctrl-S having an H-level for cutting the medium P to a predetermined size, to the medium cutting section 90. The time point t18 is a timing at which a cutting point for cutting the medium P transported by the medium transport section 80 to a predetermined size is transported below the medium cutting section 90 in the direction along the Z-direction. Thus, the medium P is cut into a predetermined size. The medium P cut at the time point t18 is transported to the discharge port 3 by the medium transport section 80. As a result, the medium P on which the desired image is formed and which is cut to a predetermined size is discharged from the discharge port 3. Then, the control circuit 100 outputs the control signal Ctrl-T for stopping the transport of the medium P to the medium transport section 80.

As described above, in the medium information acquisition mode in which the image detection section 40 in the printing apparatus 1 detects the information on the surface state of the medium P, the medium transport section 80 transports the medium P from the discharge port 3 to the medium accommodation portion 2, and the image detection section 40 detects the image information on the image formed on the medium P. The image detection section 40 corrects the image information of the image formed on the medium P by using the surface information indicating the surface of the medium P before the detected image is formed as the information of the surface state. Such a medium information acquisition mode is an example of a second mode.

In the medium information acquisition mode as illustrated in FIG. 9, when the medium transport section 80 transports the medium P, the image detection section 40 preferably detects the surface information indicating the surface of the medium P before the image is formed. Further, the image detection section 40 may detect the surface information indicating the surface of the medium P before the image is formed when the transport speed of the medium P transported by the medium transport section 80 is in an acceleration state, and detect the surface information indicating the surface of the medium P before the image is formed when the transport speed of the medium P transported by the medium transport section 80 is in a deceleration state.

When the medium P is transported by the medium transport section 80, the image detection section 40 detects the surface information indicating the surface of the medium P before the image is formed, and thus it is possible to detect the state of the surface of the medium P before the image is formed, in a wider range. As a result, it is possible to reduce the influence of the stain of the medium P locally generated on the surface of the medium P before the image is formed, the color unevenness of the medium P, and the like. Therefore, the accuracy of the formed-image information on the image formed by the ink ejected from the print head 20, which is calculated by the image determination section 130 is improved. As a result, it is possible to improve the comparison accuracy between the formed-image information calculated by the image determination section 130 and the reference image information, and to further improve the determination accuracy of the state of the image formed on the medium P and the state of the print head 20 that ejects the ink to the medium P.

As illustrated in FIGS. 8 and 9, in the image forming mode, the control circuit 100 may control the voltage supply switching section 120 to supply electric power to the medium dry-heating section 30 based on the voltage Vheat in the image forming mode. In the image information acquisition mode, the control circuit 100 may control the voltage supply switching section 120 not to supply the electric power to the medium dry-heating section 30 based on the voltage Vheat. Thus, in the image information acquisition mode in which the image detection section 40 acquires the image information on the surface of the medium P, heat generated by the medium dry-heating section 30 is reduced. As a result, when the image detection section 40 acquires the image information of the surface of the medium P, the possibility that the heat generated by the medium dry-heating section 30 is applied to the image detection section 40 is further reduced. Thus, the acquisition accuracy of image information on the surface of the medium P in the image detection section 40 is further improved.

The transport speed of the medium P in the image forming mode is preferably faster than the transport speed of the medium P in the image information acquisition mode. It is possible to improve the printing speed in the printing apparatus 1 and to improve the acquisition accuracy of the image information on the surface of the medium P in the image detection section 40 in the image information acquisition mode.

4. Advantageous Effects

In the printing apparatus 1 configured as described above in the embodiment, the print head 20 that forms an image on the medium P by ejecting the ink to the medium P, the medium dry-heating section 30 that dries the ink ejected to the medium P with heat, and the image detection section 40 that detects an image formed on the medium P are provided along the transport path HK. Thus, the print head 20 is located between the medium dry-heating section 30 and the image detection section 40 in the direction along the transport path HK. As described above, since the print head 20 is located between the medium dry-heating section 30 and the image detection section 40 along the transport path HK, the print head 20 reduces the influence of heat generated by the medium dry-heating section 30, on the image detection section 40. As a result, the possibility that the characteristics of the image detection section 40 change by the heat generated by the medium dry-heating section 30 is reduced, and thus it is possible to improve the detection accuracy of the surface state of the medium P in the image detection section 40.

In addition, the printing apparatus 1 in the embodiment includes the voltage supply switching section 120 that switches whether or not to supply electric power to the medium dry-heating section 30. The voltage supply switching section 120 supplies the voltage Vt as the voltage Vheat to the medium dry-heating section 30 in the image forming mode in which the medium transport section 80 transports the medium P in the direction from the medium accommodation portion 2 toward the discharge port 3, and the medium dry-heating section 30 dries the ink ejected to the medium P. The voltage supply switching section 120 does not supply the voltage Vt as the voltage Vheat to the medium dry-heating section 30 in the medium information acquisition mode in which the medium transport section 80 transports the medium P from the discharge port 3 toward the medium accommodation portion 2, and the image detection section 40 detects the image information on the image formed on the medium P. That is, the medium dry-heating section 30 generates heat based on the supplied voltage Vheat in the image forming mode, and does not generate heat in the medium information acquisition mode in which the image detection section 40 detects the image information on the image formed on the medium P. Accordingly, it is possible to more reduce the possibility that the characteristics of the image detection section 40 change by the heat generated by the medium dry-heating section 30, and thus it is possible to improve the detection accuracy of the surface state of the medium P in the image detection section 40.

5. Modification Examples

In the above embodiment, description has been made on the assumption that the printing apparatus 1 is a serial type ink jet printer. The printing apparatus 1 may be a so-called line type ink jet printer in which a plurality of print heads 20 are provided to be arranged in the width direction of the medium P that intersects with the transport path HK in which the medium P is transported, and the medium P is transported below the plurality of print heads 20 to form a desired image on the medium P.

In the above embodiment, description has been made on the assumption that the medium P used in the printing apparatus 1 is so-called roll paper wound in a roll shape. The medium P used in the printing apparatus 1 is not limited to the roll paper and may be a sheet of paper that has been cut to a predetermined size in advance.

Hitherto, the embodiment and the modification examples have been described above. The present disclosure is not limited to the above embodiment, and various embodiments may be implemented in a range without departing from the gist. For example, it is possible to appropriately combine the above embodiments.

The present disclosure includes a configuration that is substantially the same as the configuration described in the embodiment (for example, configuration having the same function, method and result, or configuration having the same purpose and effect). The present disclosure also includes a configuration in which a non-essential portion of the configuration described in the embodiment is replaced. The present disclosure also includes a configuration of exhibiting the same advantageous effects as the configuration described in the embodiment or a configuration capable of achieving the same purpose. The present disclosure also includes a configuration in which a known technique is added to the configuration described in the embodiment.

The contents as follows are obtained from the embodiment and the modification examples described above.

According to an aspect, the printing apparatus including: a medium accommodation portion that accommodates a medium, a medium discharge port for discharging the medium to an outside of the printing apparatus, a medium transport section that transports the medium along a transport path from the medium accommodation portion toward the medium discharge port, an ejection head that ejects a liquid to the medium to form an image on the medium, a heat generation section that dries the liquid ejected to the medium by heat, and an image detection section that detects the image formed on the medium. The ejection head, the heat generation section, and the image detection section are provided along the transport path, and the ejection head is located between the heat generation section and the image detection section in a direction along the transport path.

According to the printing apparatus, the ejection head, the heat generation section, and the image detection section are provided along the transport path, and the ejection head is positioned between the heat generation section and the image detection section in the direction along the transport path. Thus, the ejection head reduces an influence of heat generated by the heat generation section on the image detection section. As a result, the possibility that the characteristics of the image detection section change by the heat generated by the heat generation section is reduced, and thus it is possible to improve the detection accuracy of the surface of the medium in the image detection section. That is, in the printing apparatus including the image detection section, it is possible to improve the detection accuracy for detecting the state of the image formed on the medium by using the image detection section.

In one aspect of the printing apparatus, the printing apparatus may have a first mode and a second mode, the first mode being a mode in which the medium transport section transports the medium in a direction from the medium accommodation portion toward the medium discharge port, and the heat generation section dries the liquid ejected to the medium, and the second mode being a mode in which the medium transport section transports the medium in a direction from the medium discharge port toward the medium accommodation portion, and the image detection section detects image information of the image formed on the medium.

In one aspect of the printing apparatus, a transport speed of the medium in the first mode may be faster than a transport speed of the medium in the second mode.

In one aspect of the printing apparatus, the printing apparatus may further include a switch circuit that switches whether or not to supply electric power to the heat generation section.

In one aspect of the printing apparatus, the switch circuit may supply the electric power to the heat generation section in the first mode, and may not supply the electric power to the heat generation section in the second mode.

According to the printing apparatus, the electric power is not supplied to the heat generation section in the second mode in which the image detection section detects the image information of the image formed on the medium. Thus, the heat generation section does not generate heat. Therefore, when the image detection section detects the image information of the image formed on the medium, it is possible to further reduce the possibility that the heat generated by the heat generation section has an influence on the image detection section, and to improve the detection accuracy of the surface of the medium in the image detection section.

In one aspect of the printing apparatus, when the heat generation section dries the liquid ejected to the medium, an ambient temperature of the heat generation section may be higher than an ambient temperature of the image detection section.

In one aspect of the printing apparatus, a length of the ejection head in the direction along the transport path may be longer than a length of the heat generation section in the direction along the transport path.

According to the printing apparatus, it is possible to separate the heat generation section and the image detection section from each other by the ejection head. Thus, it is possible to further reduce the possibility that the heat generated by the heat generation section has an influence on the image detection section, and to improve the detection accuracy of the surface of the medium in the image detection section.

In one aspect of the printing apparatus, a length of the ejection head in the direction along the transport path may be longer than a length of the image detection section in the direction along the transport path.

According to the printing apparatus, it is possible to separate the heat generation section and the image detection section from each other by the ejection head. Thus, it is possible to further reduce the possibility that the heat generated by the heat generation section has an influence on the image detection section, and to improve the detection accuracy of the surface of the medium in the image detection section.

What is claimed is:

1. A printing apparatus comprising:

a medium accommodation portion that accommodates a medium;

a medium discharge port for discharging the medium to an outside of the printing apparatus;

a medium transport section that transports the medium along a transport path from the medium accommodation portion toward the medium discharge port;

an ejection head that ejects a liquid to the medium to form an image on the medium;

a heat generation section that dries the liquid ejected to the medium by heat; and an image detection section that detects the image formed on the medium, wherein the ejection head, the heat generation section, and the image detection section are provided along the transport path, and the ejection head is located between the heat generation section and the image detection section in a direction along the transport path.

2. The printing apparatus according to claim 1, wherein the printing apparatus has a first mode and a second mode, the first mode being a mode in which the medium transport section transports the medium in a direction from the medium accommodation portion toward the medium discharge port, and the heat generation section dries the liquid ejected to the medium, and the second mode being a mode in which the medium transport section transports the medium in a direction from the medium discharge port toward the medium accommodation portion, and the image detection section detects image information of the image formed on the medium.

3. The printing apparatus according to claim 2, wherein a transport speed of the medium in the first mode is faster than a transport speed of the medium in the second mode.

4. The printing apparatus according to claim 2, further comprising:

a switch circuit that switches whether or not to supply electric power to the heat generation section.

5. The printing apparatus according to claim 4, wherein the switch circuit supplies the electric power to the heat generation section in the first mode, and does not supply the electric power to the heat generation section in the second mode.

6. The printing apparatus according to claim 1, wherein when the heat generation section dries the liquid ejected to the medium, an ambient temperature of the heat generation section is higher than an ambient temperature of the image detection section.

7. The printing apparatus according to claim 1, wherein a length of the ejection head in the direction along the transport path is longer than a length of the heat generation section in the direction along the transport path.

8. The printing apparatus according to claim 1, wherein a length of the ejection head in the direction along the transport path is longer than a length of the image detection section in the direction along the transport path.

* * * * *